US006661343B1

(12) United States Patent
Rocci

(10) Patent No.: US 6,661,343 B1
(45) Date of Patent: Dec. 9, 2003

(54) ADAPTER FOR MOTION DETECTOR

(76) Inventor: Steven J. Rocci, 111 Ogden Ave., Swarthmore, PA (US) 19081

( * ) Notice: Subject to any disclaimer, the term of this patent is extended or adjusted under 35 U.S.C. 154(b) by 0 days.

(21) Appl. No.: 09/939,987

(22) Filed: Aug. 27, 2001

(51) Int. Cl.[7] ..... G08B 23/00
(52) U.S. Cl. ..... 340/573.1; 340/541; 340/565
(58) Field of Search ..... 340/573.1, 541, 340/565, 573.4, 825.32, 505, 539.1

(56) References Cited

U.S. PATENT DOCUMENTS 5,053,774 A 10/1991 Schuermann et al. ..... 342/44
5,351,052 A 9/1994 D'Hont et al. ..... 342/42
5,453,747 A 9/1995 D'Hont et al. ..... 342/42
5,605,182 A 2/1997 Oberrecht et al. ..... 141/94
5,689,242 A * 11/1997 Sims et al. ..... 340/652
5,745,849 A * 4/1998 Britton ..... 455/404
5,955,951 A * 9/1999 Wischerop et al. ..... 340/572.8
5,969,595 A * 10/1999 Schipper et al. ..... 340/426
6,026,868 A 2/2000 Johnson, Jr. ..... 141/94
6,057,764 A * 5/2000 Williams ..... 340/572.1
6,061,552 A * 5/2000 Cerasini et al. ..... 455/128
6,084,517 A * 7/2000 Rabanne et al. ..... 340/573.4
6,218,941 B1 * 4/2001 Cromer et al. ..... 340/572.1
6,236,314 B1 5/2001 Smith et al. ..... 340/572.7
6,236,335 B1 * 5/2001 Goodwin, III ..... 340/825.49

* cited by examiner

*Primary Examiner*—Benjamin C. Lee
*Assistant Examiner*—Phung Nguyen
(74) *Attorney, Agent, or Firm*—Steven J. Rocci, Esq.

(57) ABSTRACT

An object that can be sensed by a motion detector is equipped with a small, battery powered transponder. A motion detector has (either internally or externally) a transceiver adapted to provide a query signal. If the object is within range of the query signal, the transponder responds with a transponder signal. The transceiver is responsive to receipt of the transponder signal to prevent the detection of motion from causing an alarm.

22 Claims, 6 Drawing Sheets

ADAPTER FOR MOTION DETECTOR

FIELD OF THE INVENTION

The present invention relates generally to security systems and particularly to motion detectors for security systems, such as passive infrared (IR) detectors.

BACKGROUND OF THE INVENTION

Motion detectors for security systems are well known. The most common type of motion detector is a passive IR detector that detects motion from animate, moving objects that that emit IR, such as humans and animals. (The term "objects" as used herein includes animals and humans.)

Animals, and especially cats, pose special problems for environments employing security systems with motion detectors because they are usually free to roam spaces in which motion detectors are employed ("protected space") and hence, when the security system has been armed, they can set off an alarm when they enter the protected space. Although the protected spaces are usually zoned and specific zones can usually be bypassed, this defeats the purpose of installing the motion detector in the protected space in the first instance.

Humans also pose a problem because they might forget that the protected space has been armed with a motion detector and wonder into it. Again, though protected spaces can usually be bypassed, bypassing defeats the purpose of the alarm system, and also humans can forget to bypass the protected zones when they arm the system.

It is desirable to provide a means by which protected spaces can remain armed and protected by motion detectors, but which allows authorized objects to roam within those spaces without setting off the alarm. The present invention achieves this goal.

SUMMARY OF THE INVENTION

An object that can be sensed by a motion detector is equipped with a small, battery powered transponder. A motion detector has (either internally or externally) a transceiver adapted to provide a query signal. If the object is within range of the query signal, the transponder responds with a transponder signal. The transceiver is responsive to receipt of the transponder signal to prevent the detection of motion from causing an alarm.

DETAILED DESCRIPTION OF THE FIGURES

DETAILED DESCRIPTION OF THE PREFERRED EMBODIMENTS

The present invention is described herein in the context of the presently preferred embodiments, but is not limited thereto except as set forth in the appended claims.

Figure 1:
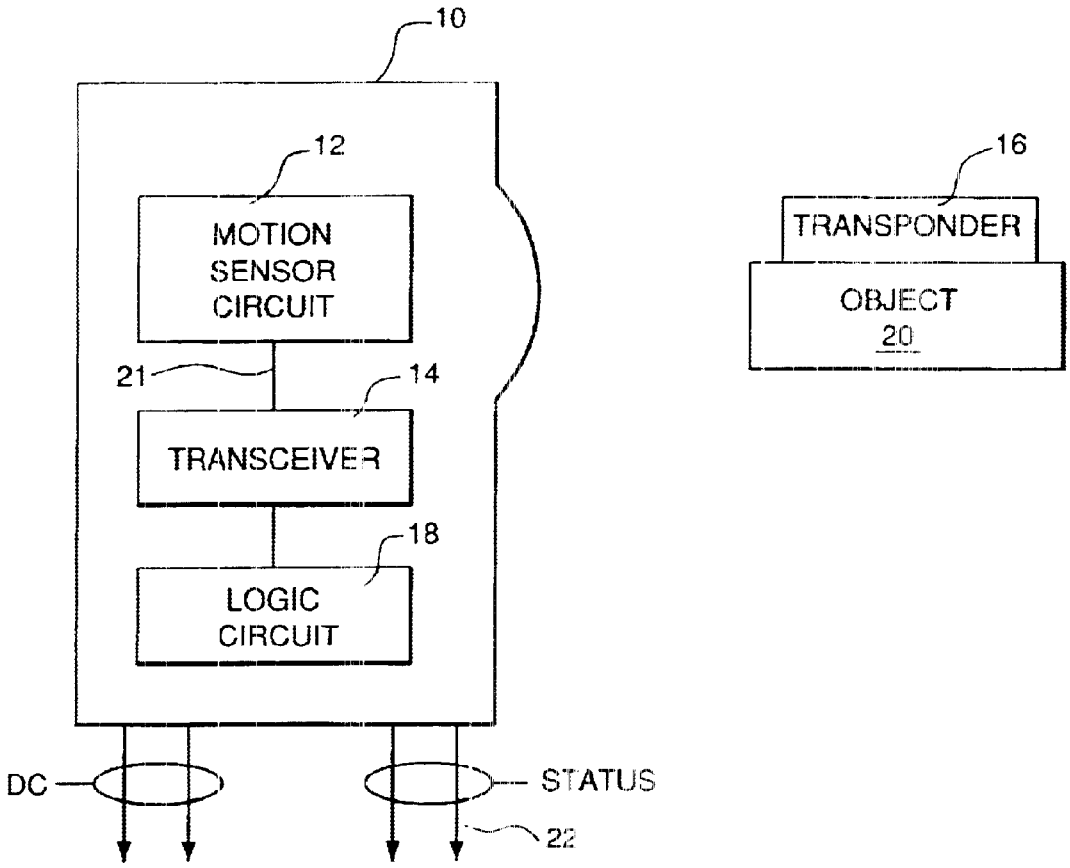
FIG. 1 is a block diagram illustrating a motion detector according to one embodiment of the present invention.

Referring to FIG. 1, there is shown a motion detector 10 having a motion sensor circuit 12 therein in well known fashion. Motion detector 10 may be a commercially available passive IR motion detector, such as the model DS774Ti (www.detectionsys.com) or DS820I manufactured by Detection Systems Inc., Fairport, N.Y. As is well known, many motion detectors 10 operate using 4 wires, two of which deliver DC power to the device, and the other two of which report status to an alarm panel (e.g., relay contact closure upon detection of motion). Wireless passive IR detectors are also known, and an embodiment of the present invention is described herein in connection with such wireless devices. As is known, the motion detector communicates with an alarm panel that sounds an alarm if motion detector 10 reports a breach indication (motion) over the status lines 22 (or wirelessly).

Motion detector 10 is equipped with a transceiver 14 that cooperates with a compact, battery powered transponder 16. Examples of such transceivers 14 and transponders 16, and systems suitable for the present invention, are described in U.S. Pat. Nos. 5,351,052; 5,453,747 and 5,053,774, and also in U.S. Pat. Nos. 6,236,314; 6,026,868 and 5,605,182, all of which are incorporated herein by reference. Commercial implementations of such devices can be found in so-called "Easy Pass" traffic/toll systems and in the Mobil Speed Pass system promoted by Mobil Oil Corporation (www.speedpass.com). As is well known in such systems, transponder 16 transmits on a unique frequency and/or using a unique code ("transponder signal") in response to a query signal from transceiver 14. Motion detector 10 is also equipped with logic circuitry 18, such as digital or analog logic circuitry. According to the invention, a transponder 16 is placed or worn on an object 20 that may enter the protected space. According to one embodiment of the invention, transceiver 14 transmits a query signal only in response to an indication of motion from the motion sensor circuitry 12 (shown on line 21). If the transponder replies with a transponder signal, then logic circuitry 18 prevents the breach indication, that would normally cause the alarm panel to generate an alarm, from doing so, e.g., by preventing the breach indication from being sent to the alarm panel over status lines 22. See FIG. 5. Otherwise, the breach indication is provided to the alarm panel. It may be desirable to adjust the transceiver 14 and transponder 16 so that their effective transmission/reception reception ranges are no greater than the detection range of motion detector 10 and/or of the area of the protected space.

In alternative embodiments, transceiver 14 transmits query signals at periodic intervals, or transmits query signals constantly, rather than in response to an indication of motion. See FIG. 6.

Figure 2:
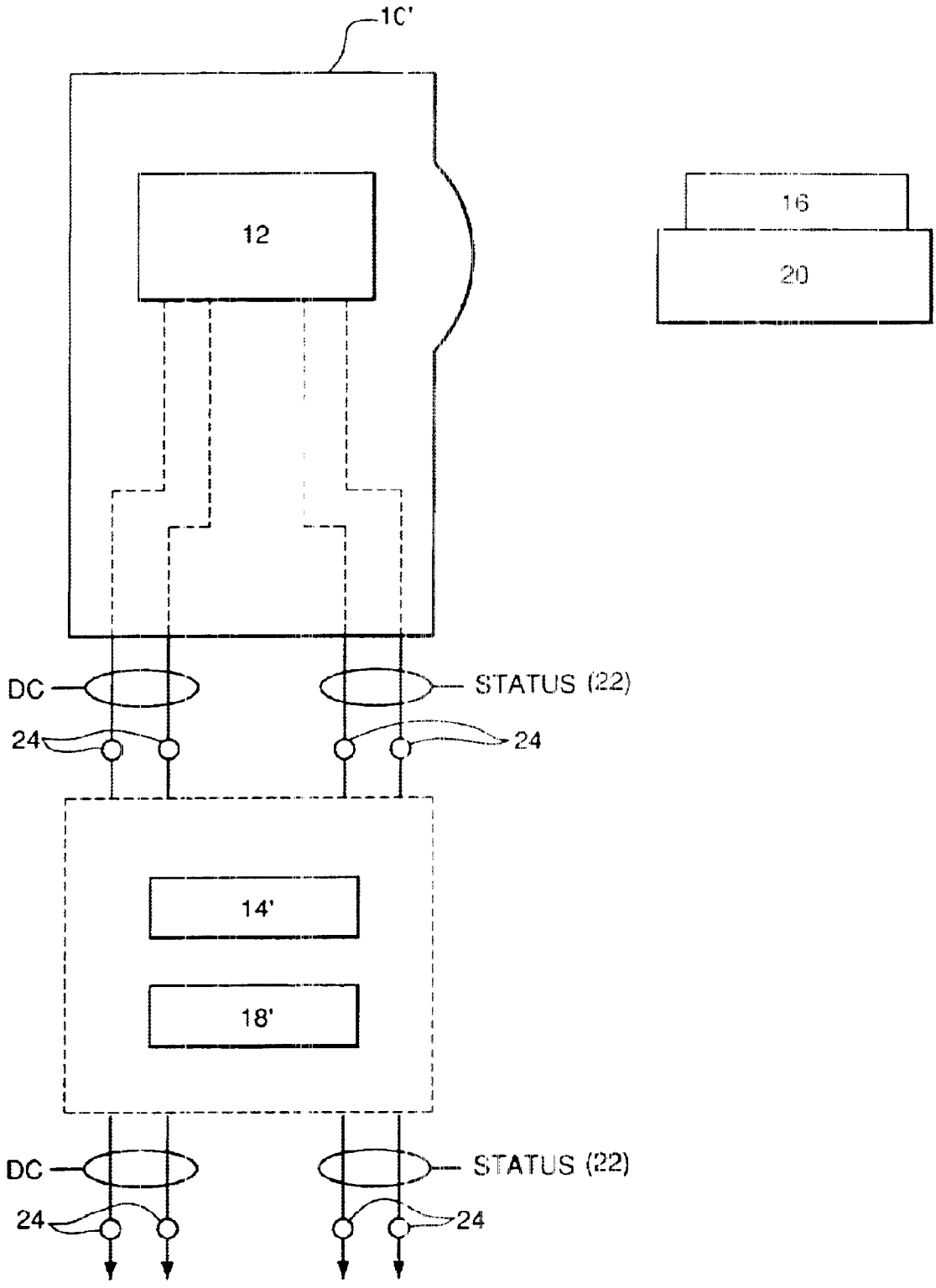
FIG. 2 is a block diagram illustrating a motion detector and an adapter therefore according to another embodiment of the present invention.

FIG. 2 illustrates an embodiment of the invention which does not require modification of a commercially available motion detector 10'. In this embodiment, the invention is provided as an adapter or retrofit device 15 that can be externally connected to the motion detector 10'. Particularly, the transceiver 14' and logic circuitry 18' receive the status lines 22 (and DC power) externally to the motion detector 10'. This can be accomplished by a simple plug and receptacle arrangement, shown by the circles 24. The transceiver 14' and logic circuitry 18' may be contained in the same or separate housings. The operation is as described above.

Figure 3:
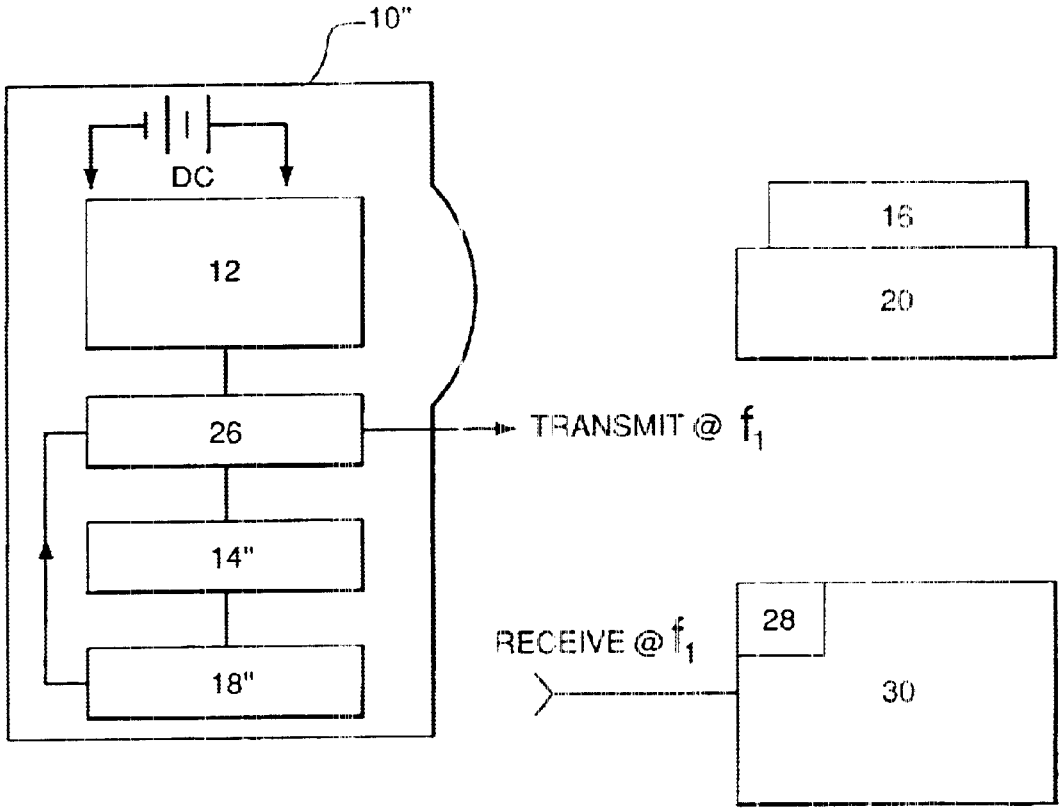
FIG. 3 is a block diagram illustrating a wireless motion detector according to one embodiment of the present invention.
Figure 5:
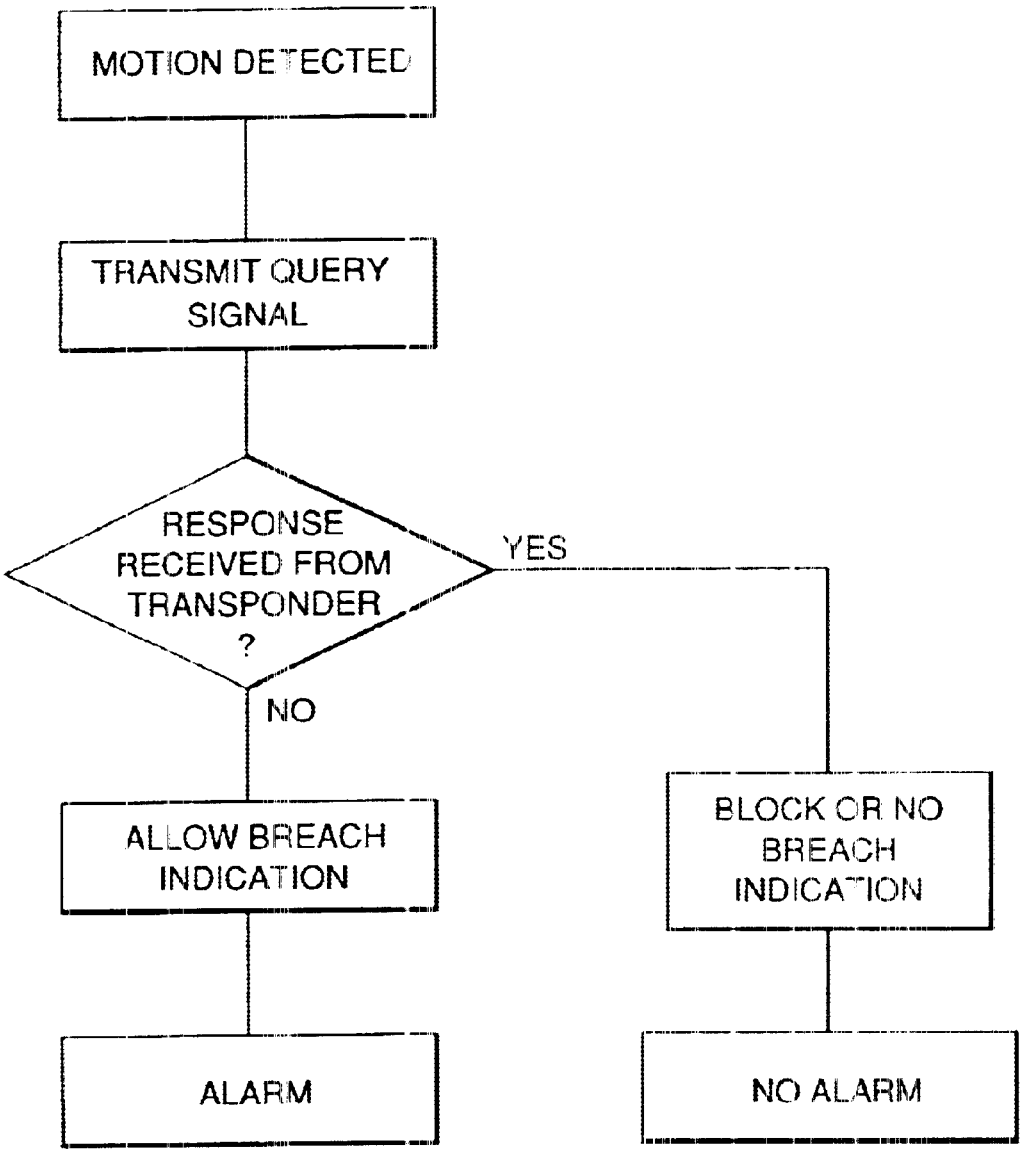
FIG. 5 is a flow diagram illustrating the operation of the devices of FIGS. 1–4 according to one method of the invention.
Figure 6:
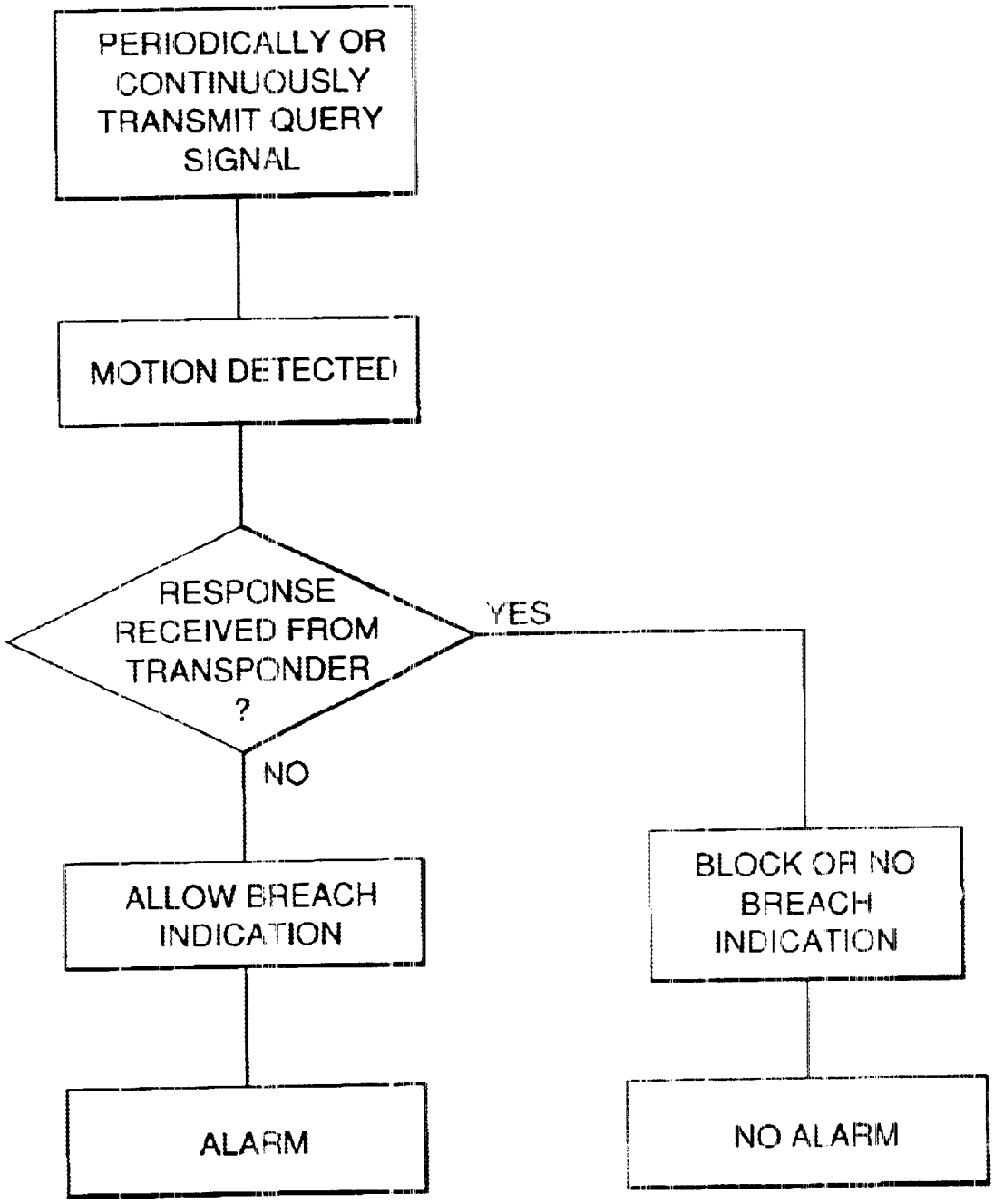
FIG. 6 is a flow diagram illustrating the operation of the devices of FIGS. 1–4 according to another method of the invention.

FIG. 3 illustrates a commercially available wireless motion detector 10" that, instead of employing status lines 22, has a built in (or external) radio transmitter 26 that is tuned to transmit a breach indication at frequency f1 in response to the detection of motion. Receiver 28 at the alarm panel 30 is likewise tuned to receive at frequency f1. If receiver 28 receives a transmitted breach indication, the alarm panel 30 sounds an alarm. (As is known, the transmitted breach indications may be coded for indication of the zone in which the breach occurred.) As in the embodiment of FIG. 1, the motion detector 10' is modified to incorporate a transceiver 14" for communicating with a transponder 16, and logic circuitry 18". Logic circuitry 18" prevents the transmitter 26 from transmitting a breach indication to the receiver 28 if, as indicated in FIGS. 5 and 6, a transponder signal is received in response to a query signal. Otherwise, the breach indication is transmitted.

Figure 4:
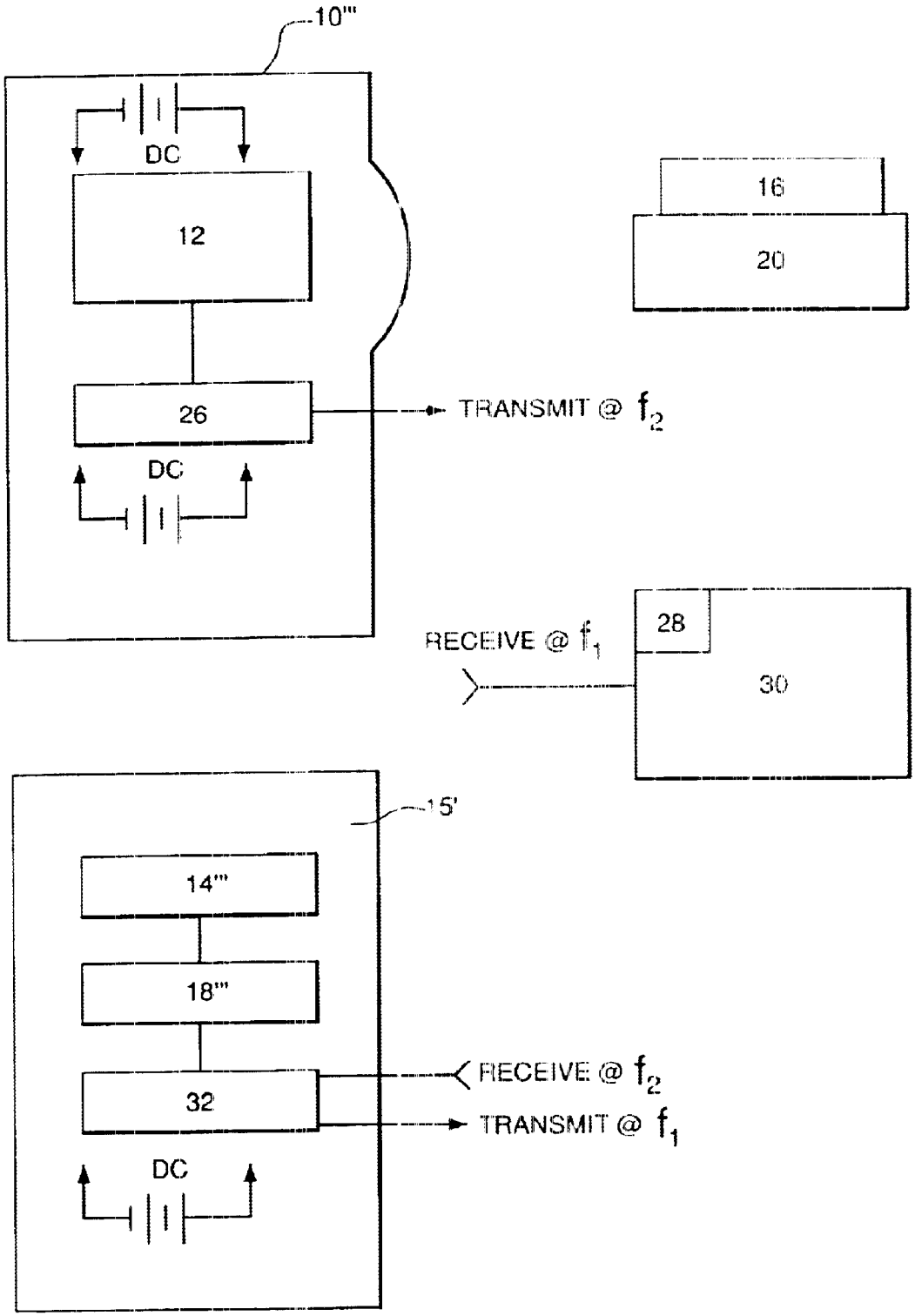
FIG. 4 is a block diagram illustrating a wireless motion detector and an adapter therefore according to another embodiment of the present invention.

The embodiment of FIG. 4 illustrates the use of an external adapter 15' for a wireless motion detector 10'" that may not require modification of the circuitry of commercially available motion detector 10'". The adapter 15' contains a transceiver 14'", logic circuitry 18'" and another transceiver 32. In this embodiment, the transmitter 26 is tuned to transmit a different frequency, f2, than the frequency f1 that the receiver 28 at alarm panel 30 is tuned to receive. Transceiver 32 is tuned to receive at f2 and transmit at f1. The adapter receives the transmitted breach indication (transmitted at f2) and retransmits the breach indication at f1 only if no transponder signal is received by transceiver 14'" in response to a query signal.

An example of a wireless motion detector 10" that may be modified as above described, or that may be employed with an adapter 15' as above described, is the Dimango® model RC2070 motion detector available from Lord Henry Enterprises, 5903 Port Andarko Trail, Hermitage, Tenn. 37076 (www.dimango.com). As shown, the wireless motion detectors 10" and 10'" may be battery powered.

In alternative embodiments, the breach indication is always permitted to be transmitted in response to motion detection, but the transmitted signals are coded with a first code if a transponder signal was received and with a second code if a transponder signal was not received. The alarm panel is programmed to cause an alarm only if the second code is received. This permits the alarm panel to track movements of transponder equipped objects in protected spaces.

Other embodiments are possible and are within the scope of the invention. Accordingly, resort should be had to the following claims, rather than the foregoing description, to ascertain the scope of the invention.

I claim:

1. An adapter for adaptable connection to a motion detector and for communication with an alarm panel, wherein the motion detector is for placement in a protected space and provides a breach indication in response to detection of motion in the protected space, the breach indication normally causing an alarm at the alarm panel, the adapter comprising:

a) a transceiver adapted to provide an indication that a signal has been received from a transponder disposed on an object within the protected space; and, b) circuitry responsive to the indication provided by the transceiver that prevents the breach indication from reaching the alarm panel and causing an alarm.

2. The adapter according to claim 1 wherein the transceiver transmits a query signal in response to the breach indication, and the transponder transmits the transponder signal in response to receipt of the query signal.

3. The adapter according to claim 1 wherein the transceiver periodically transmits a query signal and the transponder transmits the transponder signal in response to receipt of the query signal.

4. The adapter according to claim 1 wherein the transceiver constantly transmits a query signal and the transponder transmits the transponder signal in response to receipt of the query signal.

5. The adapter according to claim 1 wherein the transponder transmits the transponder signal only in response to receipt of a query signal from the transceiver.

6. The adapter according to claim 1 wherein at least one of the transceiver and transponder have a range generally corresponding to the area of the protected space.

7. The adapter of claim 1 wherein the motion sensor and adapter are disposed in the same housing.

8. The adapter of claim 1 wherein the motion sensor is disposed in a motion detector housing and the adapter is disposed outside the motion detector housing.

9. The adapter according to claim 1 wherein the connection is a hard wired connection.

10. The adapter according to claim 1 wherein the connection is a wireless connection.

11. An adapter for adaptable connection to a motion detector and for communication with an alarm system, wherein the motion detector is for placement in a protected space and provides a breach indication in response to detection of motion in the protected space, the adapter comprising:

a) a transceiver adapted to provide an indication that a signal has been received from a transponder disposed on an object within the protected space; and, b) circuitry responsive to the indication provided by the transceiver that prevents the alarm system from responding to the breach indication.

12. The adapter according to claim 11 wherein the transceiver transmits a query signal in response to detection of motion by motion detection circuitry, and the transponder transmits the transponder signal in response to receipt of the query signal.

13. The adapter according to claim 11 wherein the transceiver periodically transmits a query signal and the transponder transmits the transponder signal in response to receipt of the query signal.

14. The adapter according to claim 11 wherein the transceiver constantly transmits a query signal and the transponder transmits the transponder signal in response to receipt of the query signal.

15. The adapter according to claim 11 wherein the transponder transmits the transponder signal only in response to receipt of a query signal from the transceiver.

16. The adapter according to claim 11 wherein at least one of the transceiver and transponder have a range generally corresponding to the area of the protected space.

17. The adapter of claim 11 wherein the motion sensor and adapter are disposed in the same housing.

18. The adapter of claim 11 wherein the motion sensor is disposed in a motion detector housing and the adapter is disposed outside the motion detector housing.

19. The adapter according to claim 11 wherein the connection is a hard wired connection.

20. The adapter according to claim 11 wherein the connection is a wireless connection.

21. The adapter according to claim 20 wherein the adapter transmits a wireless breach indication to a receiver in communication with the alarm panel only if no transponder signal has been received by the transceiver.

22. The adapter according to claim 20 wherein the adapter transmits a wireless breach indication to a receiver in communication with the alarm panel only if no transponder signal has been received by the transceiver.

* * * * *